United States Patent [19]

Fencl

[11] 4,357,561

[45] Nov. 2, 1982

[54] AUTOMOTIVE RIM ROLL FORMING DRIVE SYSTEM

[75] Inventor: Vernon R. Fencl, Northbrook, Ill.

[73] Assignee: Grotnes Metalforming Systems, Inc., Chicago, Ill.

[21] Appl. No.: 301,394

[22] Filed: Sep. 11, 1981

Related U.S. Application Data

[62] Division of Ser. No. 129,725, Mar. 27, 1980, Pat. No. 4,320,327.

[30] Foreign Application Priority Data

Apr. 6, 1979 [JP] Japan ..... 54-42349

[51] Int. Cl.[3] ..... B21B 37/00

[52] U.S. Cl. ..... 318/50; 318/98; 318/112

[58] Field of Search ..... 72/19; 318/49, 50, 112, 318/111, 113, 98, 99

[56] References Cited

U.S. PATENT DOCUMENTS

| | | | |
|---|---|---|---|
| 3,353,384 | 11/1967 | Perkain et al. | 318/99 |
| 3,906,764 | 9/1975 | Mueller | 72/19 X |
| 4,145,901 | 3/1979 | Imai et al. | 72/19 X |

*Primary Examiner*—Ulysses Weldon

*Attorney, Agent, or Firm*—Leydig, Voit, Osann, Mayer & Holt, Ltd.

[57] ABSTRACT

An electric drive system for automotive wheel rim forming equipment having inner and outer forming rolls mounted on driven spindles. The drive system includes separate drives for each forming roll and a control system for maintaining a predetermined speed ratio between the forming rolls in the absence of a working load thereon. The control system further maintains a predetermined torque ratio between the outputs of the drives for the forming rolls during the forming of a wheel rim by the forming rolls.

1 Claim, 6 Drawing Figures

AUTOMOTIVE RIM ROLL FORMING DRIVE SYSTEM

This is a division of application Ser. No. 129,725, filed 3/27/80 now U.S. Pat. No. 4,320,327.

DESCRIPTION OF THE INVENTION

The present invention relates generally to roll forming of automotive wheel rims and, more particularly, to electric drive systems for such roll forming equipment.

It is a primary object of the present invention to provide an improved electric drive system which maintains a predetermined torque ratio between the inner and outer forming rolls of automotive wheel rim forming equipment while the rolls are forming a rim, so that the surface speeds of the forming rolls are closely matched by the load sharing between the two rolls. In this connection, a related object of the invention is to provide such a drive system which maximizes the efficiency of the forming operation, minimizes forming time, reduces scuffing of the workpiece, and extends the life of the forming rolls.

It is another object of this invention to provide an improved electric drive system of the foregoing type which maintains a predetermined speed ratio between the inner and outer forming rolls when they are not loaded, i.e., when they are not engaging a workpiece.

A further object of this invention is to provide such an improved electric drive system which is capable of providing efficiencies as high as 90–95% in utilization of the power input to the drive system.

Still another object of the invention is to provide such an improved electric drive system which permits maximum power transmission from the driven forming rolls to the rim being formed.

Yet another object of this invention is to provide such an improved electric drive system which is relatively quiet and which also provides considerable flexibility for the forming of rims of different sizes and configurations.

Other objects and advantages of the invention will be apparent from the following detailed description.

In accordance with the present invention, there is provided an electric drive system for automotive wheel rim forming equipment having inner and outer forming rolls mounted on driven spindles, the drive system comprising separate drive means for the inner and outer spindles, means for maintaining a predetermined speed ratio between the drive means for the inner and outer spindles in the absence of a working load thereon, and means responsive to the power input to at least one of the drive means for maintaining a predetermined torque ratio between the outputs of the drive means during variations in the loads on the forming rolls during the forming of a wheel rim by the rolls.

While the invention will be described in connection with certain preferred embodiments, it will be understood that it is not intended to limit the invention to these particular embodiments. On the contrary, it is intended to cover all alternatives, modifications and equivalent arrangements as may be included within the spirit and scope of the invention as defined by the appended claims.

Figure 1:
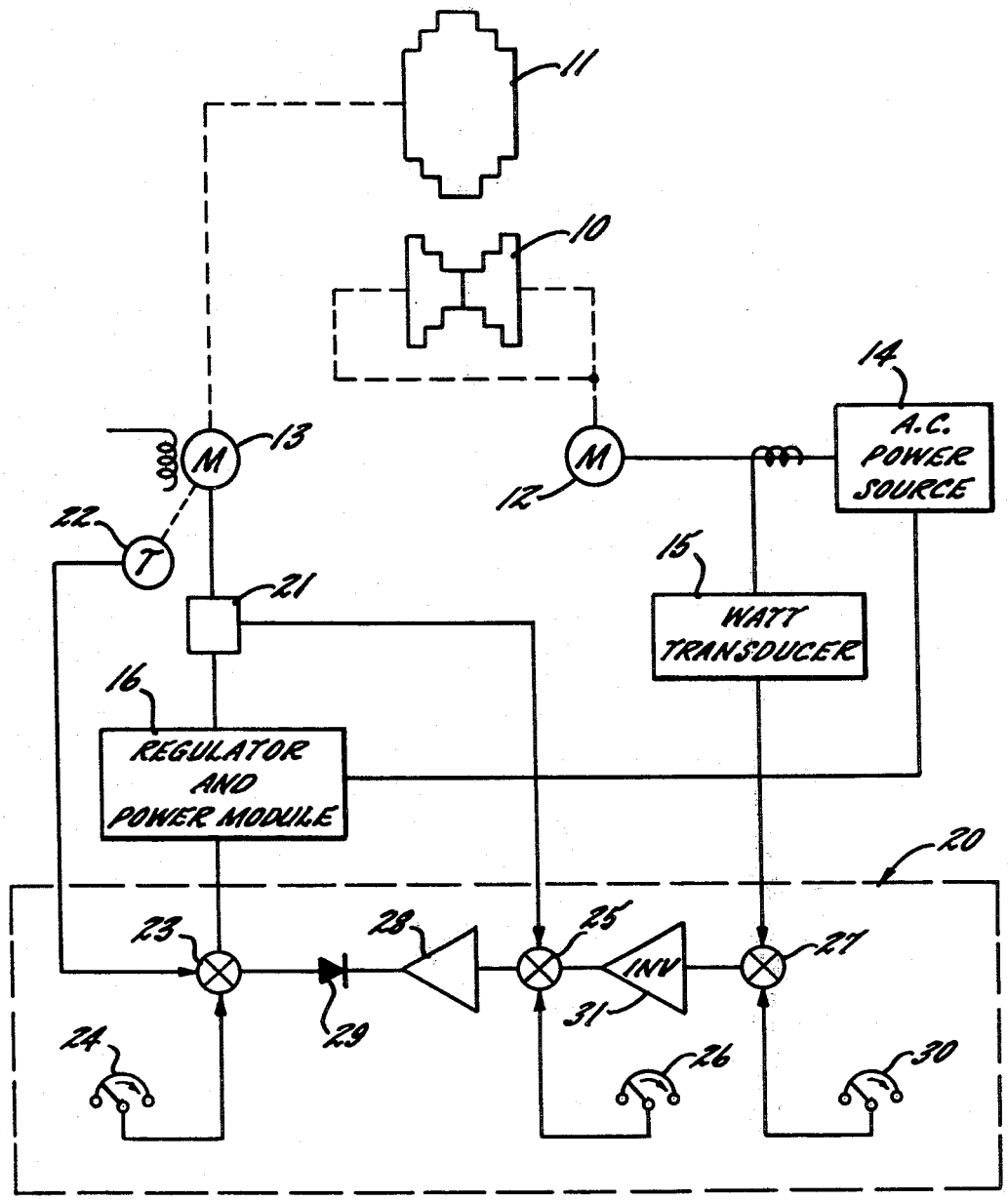
FIG. 1 is a schematic diagram of an electric drive system embodying the present invention.

Turning now to the drawings and referring first to FIG. 1, a pair of forming rolls 10 and 11 are driven by an a-c. motor 12 and a d-c. motor 13, respectively. The forming rolls 10 and 11 are used to form the desired profile in an automotive wheel rim (not shown). The starting rim blank is formed by cutting a steel plate to a fixed length and then coiling and welding it into a cylindrical blank which is placed between the two forming rolls. The forming operation is typically carried out by driving the inner roll 10 at a fixed speed while driving the outer roll 11 at speeds that are varied as the forming operation proceeds. Because the maximum load point between the inner and outer roll surfaces and the work piece surface shifts as the forming of the wheel rim proceeds, it is necessary to change the rotational speed of the outer roll 11 so that the circumferential speeds of the inner and outer forming rolls are closely matched at points of maximum load applied to the workpiece by the inner and outer roll surfaces. In the past, the driving of the forming rolls 10 and 11 has normally been effected by hydraulic motors which were relatively large and complicated in their control systems and which were limited to efficiencies on the order of 70–80%.

Power is supplied to both the motors 12 and 13 from an a-c. power source 14. The a-c. motor 12 is preferably a constant speed induction motor which draws current from the source 14 at a level dependent upon the load applied to the motor, i.e., the load on the inner forming roll 10.

The armature of the d-c. drive motor 13 is supplied with current from the power source 14 via a regulator and power module 16. Thus, the torque applied to the outer forming roll 11, as well as the velocity of this forming roll, is controlled by the regulator 16 which regulates the current supplied to the motor armature according to a signal from a control system 20 which receives feedback signals from an armature current sensor 21 and a tachometer 22. The signal from the current sensor 21 represents the magnitude of current flowing through the armature of the d-c. motor 13 at any given time, and this current level is in turn proportional to the actual output torque being produced by the d-c. drive motor 13. The signal from the tachometer 22 represents the actual velocity of the outer forming roll 11 at any given time.

The signal from the tachometer 22, representing the actual velocity of the outer forming roll 11, is negative and is continuously applied to the inverting input of a summing junction 23. The other input to this junction 23 is a reference velocity signal having a polarity opposite that of the actual velocity signal. This positive reference velocity signal is derived from a reference voltage source 24 and applied to the summing junction 23. Thus, the actual velocity and reference velocity signals are algebraically summed at the junction 23 to produce a velocity error signal proportional to the difference between the actual velocity of the outer roll 11 and the velocity represented by the reference signal. This velocity error signal is supplied to the regulator and power module 16 to control the level of current fed to the armature of the motor 13 from the power source 14. The armature current level, of course, controls the output torque applied by the d-c. motor to the forming roll 11.

As thus far described, ignoring for the moment the third input to the summing point 23, the control system 20 operates to control the speed of the inner forming roll 10 relative to the speed of the outer forming roll 11. In the no-load condition, such as between rim forming operations, the inner forming roll is maintained at a constant speed by the constant speed induction motor 12 as mentioned above. The speed of the outer forming roll 11 is controlled by the input from the summing junction 23 to the regulator and power module 16. The regulator and power module 16 typically includes a plurality of thyristors whose firing angles are varied in accordance with the voltage from the summing point 23 to control the amount of armature current to the d-c. motor 13.

In the no-load condition, the armature current level, and hence the torque level, corresponding to a desired speed for the motor 13 and outer forming roll 11 is determined and an appropriate positive speed reference voltage is set to be produced by the reference source 24. A positive voltage at the summing junction 23 will cause the regulator and power module 16 to provide more armature current, increasing the torque of the motor; and in the unloaded condition, the motor speed increases. As the motor speed increases the negative signal from the tachometer 22 into the summing junction 23 increases until it notches the positive reference signal, and the desired speed established by the speed reference source 24 is obtained.

The relative speeds of the unloaded forming rolls are maintained so that their initial contact with a rim to be formed is optimal. Once the rim to be formed is contacted by the forming rolls, the third input to the summing junction 23, which is coupled through the diode 29, substantially takes control of the regulator and power module 16 producing the dominant effect at the junction 23. Since the speed reference level is set to produce an outer forming roll 11 speed greater than the maximum that is called for in the forming operation, the roll 11 is always loaded during a forming operation and the third input to the summing junction 23 predominates in the loaded condition.

The third input to the summing junction 23 is another negative signal derived from a summing junction 25, which receives negative signals from the d-c. armature current sensor 21 and a positive signal from a minimum current source 26 and a signal from a third summing junction 27. The signal from the minimum current source 26 represents the current level required by the d-c. motor 13 to produce an output torque that is merely sufficient to overcome friction while idling. The output of the summing junction 25 is coupled through an amplifier 28 and, if negative, through a diode 29 to the summing junction 23. When there is no load on the forming rolls 10 and 11 this signal is of a magnitude such that the actual velocity signal from the tachometer 22 and the reference velocity signal from the source 24 regulate the current supply to the d-c. motor 13 to operate that motor at the desired predetermined speed. In this no-load condition, there is no output signal from the summing junction 27 because an a-c. bias signal source 30 zeros out the output signal from the watt transducer 15 when the a-c. motor 12 is merely drawing enough power to overcome friction while idling.

When a load is placed on the forming rolls 10 and 11, the illustrative system is automatically converted from a speed-controlled mode to a torque-controlled mode. Thus, the imposition of a load on the forming rolls 10 and 11 causes the a-c. motor 12 to draw more power, which increases the magnitude of the negative output signal from the watt transducer 15, thereby producing a negative output signal from the summing junction 27. The negative signal from the junction 27 is passed through amplifier-inverter 31 thereby becoming a positive input to the summing junction 25. In the torque-controlled mode of operation, the inverted output of the watt transducer 15, modified by the AC bias source 30, serves as a torque reference signal which is compared with the actual torque output of the d-c. motor, as represented by the negative signal from the armature current sensor 21. These two signals are algebraically summed at the junction 25 to produce a torque error signal that is proportional to the difference between the actual torque being furnished by the d-c. motor and the desired torque as represented by the output of the watt transducer 15. This torque error signal, if negative, is coupled through the amplifier 28 and diode 29 to the regulator 16 to control the level of current fed to the armature of the d-c. motor 13, thereby maintaining a predetermined torque ratio between the outputs of the two drive motors 12 and 13.

If the positive contribution at the summing point 25 from the watt transducer 15 exceeds the negative contribution from the actual torque sensor 21, this positive signal appears at the output of the amplifier 28 but is not coupled through the reverse-poled diode 29 to the summing junction 23. In this condition, the desired d-c. motor torque to maintain the fixed torque ratio has not been obtained. However, the above-described net positive voltage at the summing junction 23 from the contributions of the tachometer 22 and the speed reference source 24 is positive, in the absence of a contribution from the third input to the summing junction, which will act through the regulator and power module 16 to increase the armature current and torque of the d-c. motor 13.

In the event that the actual torque of the d-c. motor 13 exceeds the desired torque required to maintain the fixed torque ratio, the summing junction 25 is negative, and the output of the amplifier 28 is consequently negative. This negative voltage is coupled through the diode 29 to the summing junction 23 and to the regulator 16, which reduces the current and the torque of the d-c. motor 13.

Figure 2:
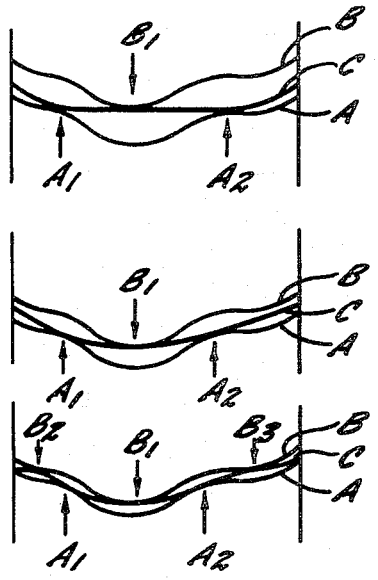
FIG. 2 is a diagrammatic illustration of successive stages of a forming operation carried out by a pair of forming rolls driven by the system illustrated in FIG. 1.

FIG. 2 schematically illustrates successive stages of a typical forming operation in which the circumferential surfaces A and B of the two forming rolls 10 and 11, respectively, engage a workpiece C. When the forming rolls initially engage the workpiece, the inner roll surface A engages the workpiece at points A1 and A2, while the roll surface B engages the workpiece at point B1. As the forming operation progresses, the contact points A1 and A2 of the inner roll surface A gradually shift inwardly. The contact point B1 of the outer roll surface B remains in substantially the same position, but new contact points B2 and B3 appear on the outer roll surface B. By maintaining a predetermined torque ratio between the outputs of the drive motors for the two forming rolls, the circumferential speed of the maximum load point on the outer roll surface B remains closely matched to the circumferential speed of the maximum load point on the inner roll surface A; even though the absolute magnitude of the torques might change, the ratio between the two torques remains substantially constant. This load sharing between the two forming rolls maximizes the efficiency of the work, minimizes forming time, reduces scuffing of the workpiece, and extends the life of the forming rolls.

Figure 3:
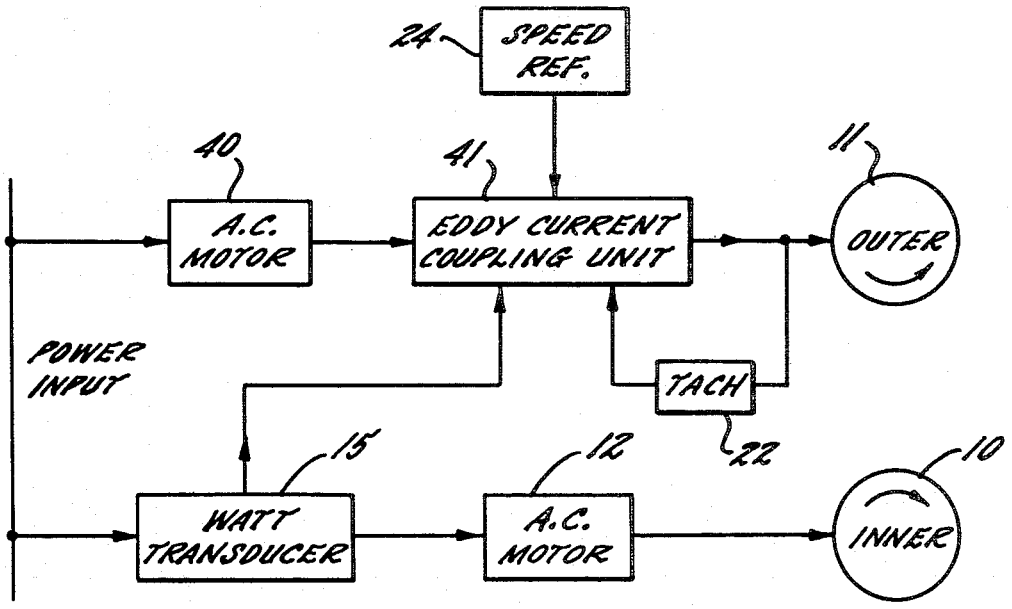
FIG. 3 is a block diagram of an electric drive system representing a modified embodiment of the present invention.

In a modified embodiment of the invention as illustrated in FIG. 3, the d-c. drive motor for the outer forming roll is replaced by the combination of an a-c. motor 40 and an eddy current coupling unit 41. The signal from the watt transducer 15, representing the power input to the a-c. motor 12 for the inner forming roll, is supplied to the eddy current coupling unit 41 along with the velocity reference signal from the source 24 and the actual velocity signal from the tachometer 22. When there is no load on the forming rolls, the speed of the outer forming roll is regulated by the velocity reference signal and the actual velocity signal in the same manner described above in connection with the d-c. motor 13. When the forming rolls are loaded, the signal from the watt transducer 15 increases and overrides the speed control signals so that the torque supplied to the outer forming roll becomes dependent on the power input to the a-c. drive motor 12 for the inner forming roll, thereby maintaining a constant predetermined ratio between the output torque of the two drive motors 12 and 40.

Figure 4:
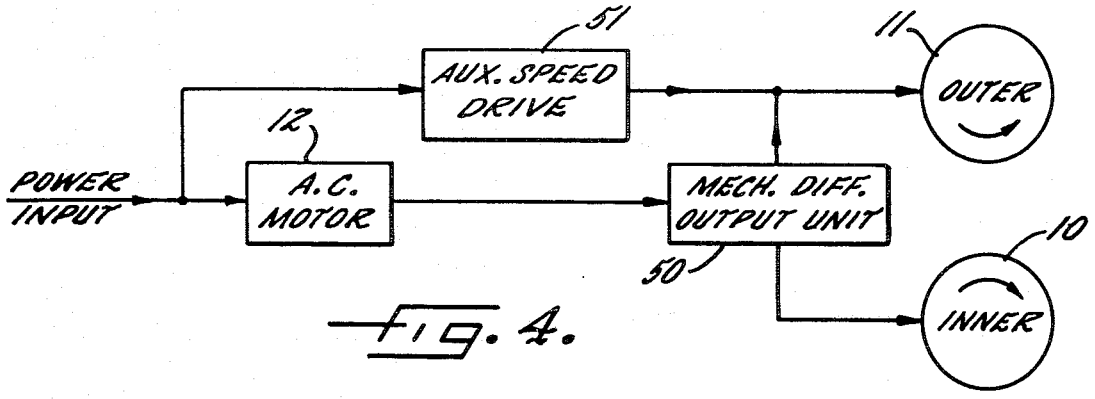
FIG. 4 is a block diagram of an electric drive system representing another modified embodiment of the present invention.

In the further modified embodiment of FIG. 4, a single a-c. motor 12 drives both forming rolls 10 and 11 through a mechanical differential output unit 50. The differential output unit 50 supplies a fixed torque ratio output to the forming rolls 10, 11. In the unloaded condition the differential output unit 50 establishes a speed ratio between the rolls 10, 11 based on frictional resistance differences of the two forming rolls. In order to set the no load speed ratio at a desired value, an auxiliary speed drive 51 is coupled to the outer forming roll 11 and placed at the necessary setting. When the forming rolls 10 and 11 are loaded, the mechanical differential output unit delivers torque to each of the rolls according to its preset torque ratio. The mechanical differential output unit conveniently accommodates speed variations between the two rolls during a forming operation by its maintenance of the torque ratio. In the loaded condition the auxiliary speed drive 51 is either disconnected from the power input or decoupled from the forming roll 11.

Figure 5:
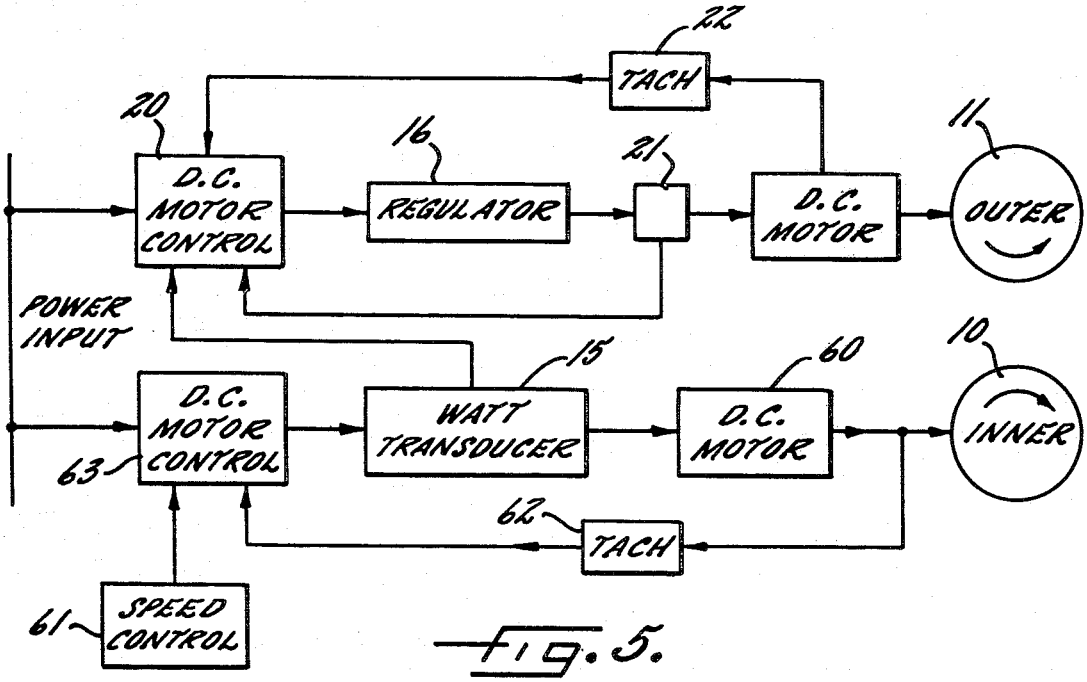
FIG. 5 is a block diagram of an electric drive system representing still another modified embodiment of the present invention.

In another modified embodiment of the invention illustrated in FIG. 5, the a-c. motor 12 in the system of FIG. 1 is replaced by a d-c. motor 60 which is operated at a constant speed set by a velocity reference signal from a speed control source 61. This velocity reference signal is continuously summed with an actual velocity signal from a tachometer 62 in a d-c. motor control unit 63, which regulates the armature current supplied to the d-c. motor 60 to maintain a constant speed. The armature current supplied to the d-c. motor 60 is sensed by the watt transducer 15 which supplies a torque reference signal to the control system for the second d-c. motor 13. It will be understood that the d-c. motor 13 is controlled in exactly the same manner described above in connection with FIG. 1, maintaining the desired predetermined torque ratio between the two forming rolls 10 and 11 when they are loaded.

Figure 6:
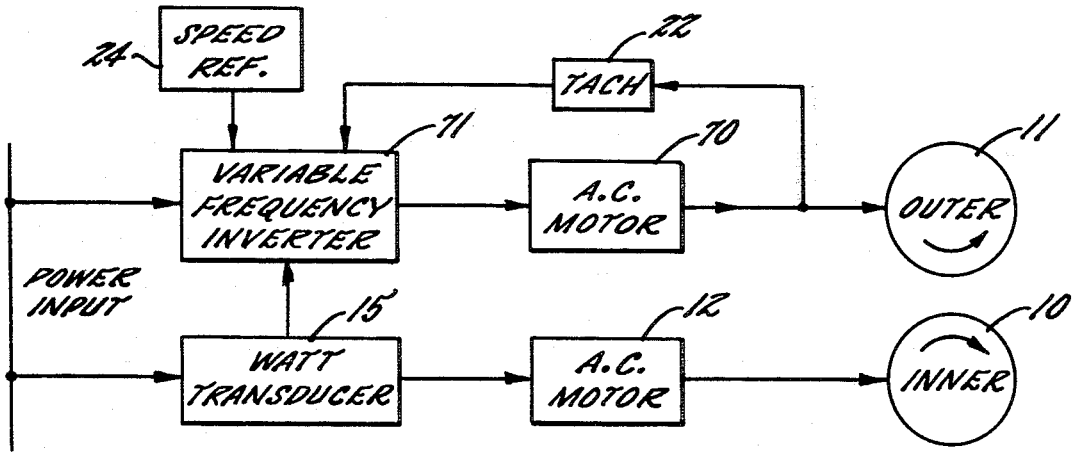
FIG. 6 is a block diagram of an electric drive system representing a further embodiment of the present invention.

Yet another modified embodiment of the invention is illustrated in FIG. 6, which utilizes a second a-c. motor 70 to drive the outer forming roll 11. When there is no load on the forming rolls, the speed of the outer forming roll 11 is controlled by a velocity reference signal from the reference source 24 and an actual velocity signal from the tachometer 22, both of which are supplied to a variable frequency inverter 71 to regulate the speed of the motor 70. When a load is applied to the forming rolls 10 and 11, the signal from the watt transducer causes the variable frequency inverter 71 to vary the power output of the a-c. motor 70 so as to maintain the desired torque ratio between the two forming rolls 10 and 11.

I claim as my invention:

1. An electric drive system for an automotive wheel rim forming system having inner and outer forming rolls mounted on driven spindles, said drive system comprising a pair of d-c. motors each driving one of said spindles;

means for maintaining a predetermined speed ratio between said inner and outer spindles in the absence of a working load thereon, said speed ratio-maintaining means including means for regulating the armature current supplied to said d-c. motors to control the speeds of said motors;

means for generating a signal representing the magnitude of the armature current applied to one of said motors, and control means responsive to said signal for varying the armature current supplied to the other of said motors so as to maintain a predetermined torque ratio between the outputs of said d-c. motors during variations in the loads on said forming rolls.

* * * * *